US005779051A

United States Patent [19]

Boutin

[11] Patent Number: 5,779,051

[45] Date of Patent: Jul. 14, 1998

[54] TWO-PLANE STACKING CONTAINER FOR LIQUIDS

[76] Inventor: Raymond Boutin, 865, rue Mackenzie, Boucherville, Québec, Canada, J4B 5W9

[21] Appl. No.: 708,823

[22] Filed: Sep. 9, 1996

[51] Int. Cl.[6] ..... B65D 1/24

[52] U.S. Cl. ..... 206/504; 206/511; 206/512; 200/23.6

[58] Field of Search ..... 220/23.6, 503, 220/504, 509, 597, 511

[56] References Cited

U.S. PATENT DOCUMENTS

| | | | |
|---|---|---|---|
| D. 333,978 | 3/1993 | Zutler | D9/424 |
| 3,583,590 | 6/1971 | Ferrare | 215/10 |
| 3,746,200 | 7/1973 | Flider | 215/10 |
| 3,756,396 | 9/1973 | Kilroy | 206/509 |
| 3,782,602 | 1/1974 | Page | 222/143 |
| 4,258,847 | 3/1981 | Nigerman | 206/504 |
| 4,351,454 | 9/1982 | Maynard, Jr. | 222/143 |
| 4,489,839 | 12/1984 | Epperson | 215/10 |
| 4,541,529 | 9/1985 | Hestehave et al. | 206/510 |
| 4,573,595 | 3/1986 | Mednis | 215/10 |
| 4,805,793 | 2/1989 | Brandt et al. | 215/10 |
| 4,863,222 | 9/1989 | Posso | 206/504 |
| 4,949,872 | 8/1990 | Heaps, Jr. | 222/105 |
| 5,064,101 | 11/1991 | Richter et al. | 222/143 |
| 5,163,587 | 11/1992 | Apps et al. | 222/105 |
| 5,167,336 | 12/1992 | Cajovic | 206/504 |
| 5,265,743 | 11/1993 | Frohn | 215/10 |
| 5,307,956 | 5/1994 | Richter et al. | 222/143 |
| 5,465,865 | 11/1995 | Coombes | 220/410 |
| 5,485,920 | 1/1996 | Fritz | 206/509 |

*Primary Examiner*—Joseph M. Moy
*Attorney, Agent, or Firm*—Jean H. Dubuc

[57] ABSTRACT

A container for liquids is configured for two-plane stacking with one or two similarly constructed containers; it comprises a body having a rectanguloid configuration with a top wall defining a recessed liquid pouring spout area and a raised handle area. The bottom wall has an underface included within a downwardly extending peripheral border defined by a series of spaced legs and pockets between the legs. The configurations of the top and bottom walls allow such containers to be stacked in two planes: one plane includes containers one directly above the other or one above the other but vertically offset thereto; a second plane includes containers in vertical planes 90° to one anoother. The handle area has rectangular planar faces and a handle bar therebetween, both cooperating with the legs and pockets of one or two superposed containers to secure them in stacked relations.

6 Claims, 6 Drawing Sheets

TWO-PLANE STACKING CONTAINER FOR LIQUIDS

FIELD OF THE INVENTION

The present invention relates to a container for liquids and, more particularly, to a container which is configured for two-plane stacking with similarly-constructed containers, that is either in a common vertical plane or in planes 90° to one another.

BACKGROUND OF THE INVENTION

Containers having pouring spouts thereon are well known. Various arrangements have been devised allowing these types of containers to be stacked either for display or transport purposes. Examples of such containers may be found described in U.S. Pat. No. 4,351,454 issued Sep. 28, 1982 to Maynard; U.S. Pat. No. 4,541,529 issued Sep. 17, 1985 to Hestehave et al.; U.S. Pat. No. 5,064,101 issued Nov. 12, 1991 to Richter; and U.S. Pat. No. 5,265,743 issued Nov. 30, 1993 to Frohn.

However, all of these containers, as well as other known containers for liquids, are only capable of being stacked in one single plane, i.e. one on top of the other. Whenever it is required for display purposes to form a stacking arrangements formed of horizontal rows of containers, it is often required to lay a board or like support between the rows.

OBJECTS AND STATEMENT OF THE INVENTION

It is an object of the present invention to provide a container for liquids which is configured for various stacking arrangements with similarly-constructed containers.

This is achieved by providing particular configurations to the top wall and to the bottom wall of a container allowing it to be stacked in a first relationship wherein the containers are in a common vertical plane or in a second relationship wherein the containers are in planes 90° to one another. Furthermore, in the first relationship, the containers may be vertically offset to one another and/or disposed 180° to one another The present invention therefore relates to a container for liquids configured for two-plane stacking with similarly constructed containers comprising: a body having a rectanguloid configuration including a front wall, a rear wall, a pair of opposite side walls, a bottom wall and a top wall; the top wall including a top surface having a recessed liquid pouring spout area and a raised handle area; the handle area including a handle bar and a rectangular planar face contiguous with each opposite end of the handle bar; the bottom wall having an underface included within a downwardly extending peripheral border defined by a series of spaced legs and displaying pockets between the legs; the legs being adapted to rest on the top surface of one or two containers when disposed therebeneath in stacked relation; the handle bar being adapted to extend through pockets of two containers when either stacked in planes 90° to one another or when stacked in a common plane but vertically offset to one another; the raised handle area being received within the border under the underface of a superposed container vertically stacked thereunder; the rectangular planar faces and the handle bar of one container cooperating with the legs and pockets of another container to secure the containers in stacked condition.

In one form of the invention, the handle bar includes small projections on opposite sides thereof to further secure the stacked containers together.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

DESCRIPTION OF PREFERRED EMBODIMENTS

Figure 1:
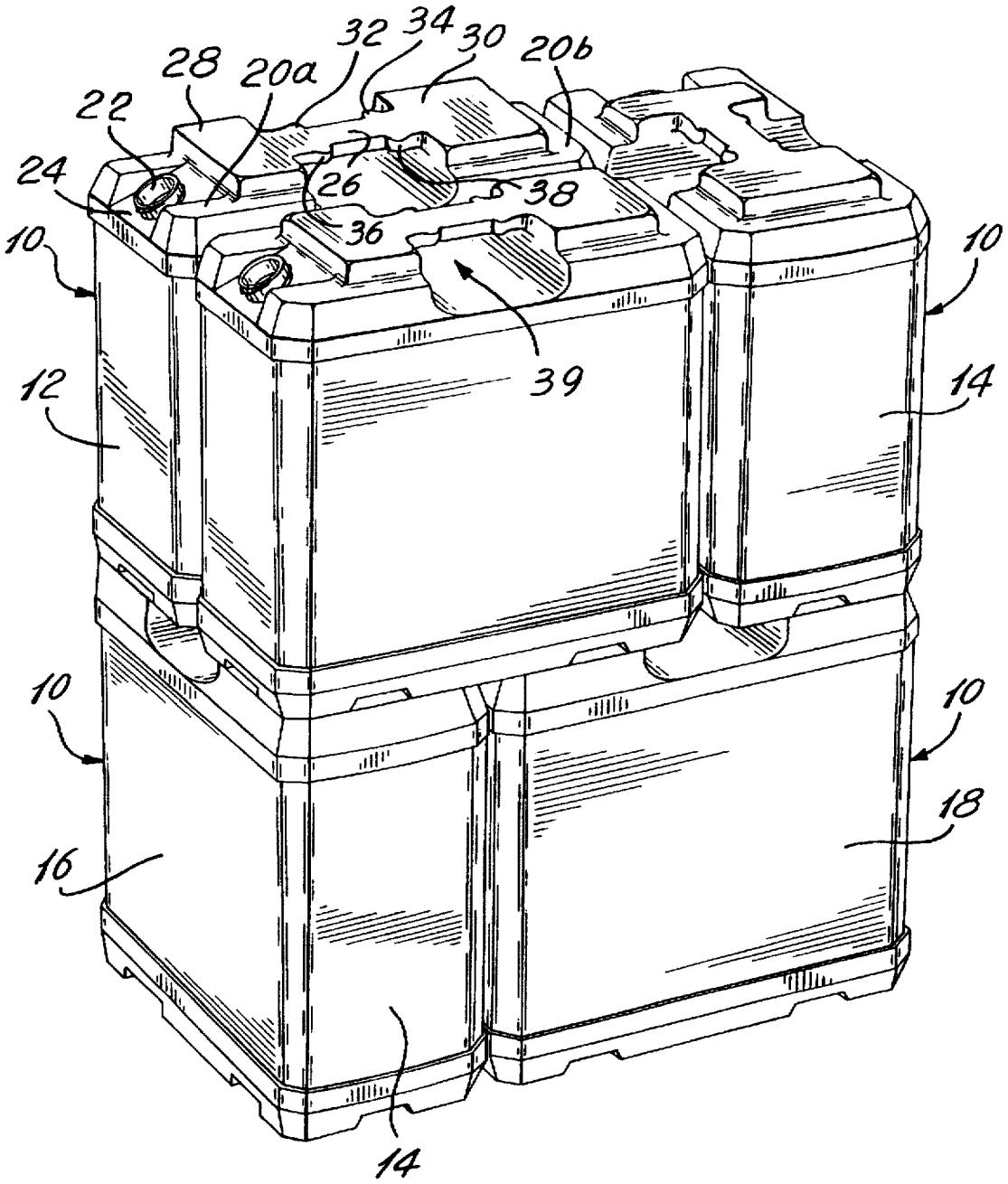
FIG. 1 is a perspective view of a plurality of containers made in accordance with the present invention in various stacking relationships to one another.

Referring to FIG. 1, there is shown an arrangement of stacked containers 10 which are geometrically identical and therefore bear like reference numerals.

The illustrated container 10 is a unitary body which may be formed of thermoplastics material (by blow molding, for example) or of metal. The container 10 has a rectanguloid configuration with a front wall 12, a rear wall 14 and opposite side walls 16 and 18. The width of the front and rear walls is about half that of the opposite walls. The top wall of the container 10 defines a surface having a front portion **20*a* and a rear portion 20*b*. The front part 20*a* displays a recessed liquid pouring spout area that includes a spout opening 22 extending over an inclined surface 24. Raised above the top surface portions 20*a*, 20*b*, extends a handle area that consists essentially of a handle bar 26 integral with two opposite rectangular planar faces 28 and 30; the surface area of front face 28 is slightly smaller than that of the rear face 30 due to the presence of the spout area. The handle bar 26 displays a pair of small rounded protrusions 32 and 34, 36 and 38, the function of which will be described hereinbelow. A finger-receiving recessed area 39 is provided beneath the handle bar 26**.

Figure 2:
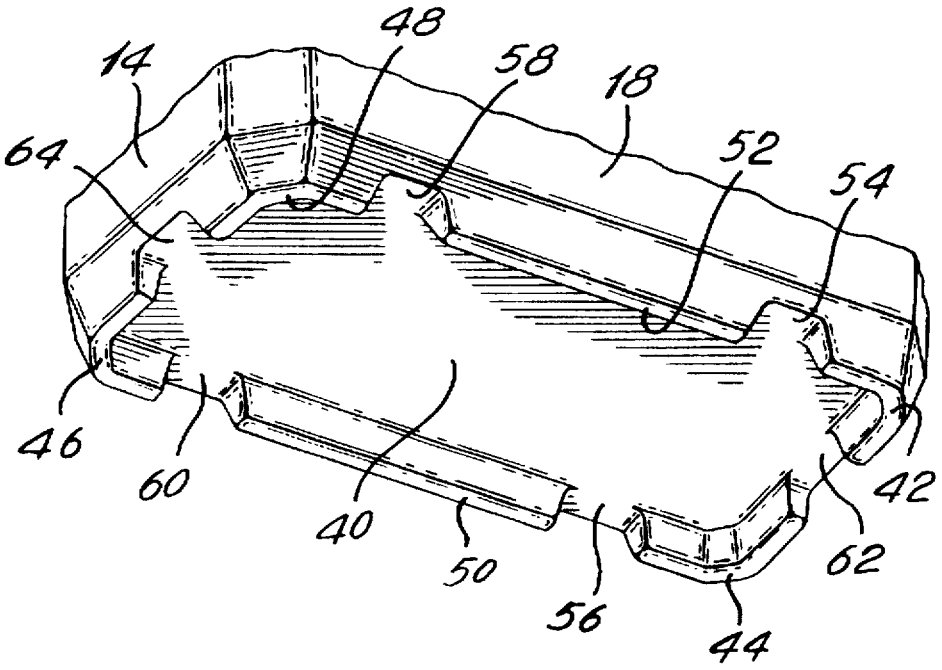
FIG. 2 is a fragmentary perspective view showing the bottom wall of the container of the present invention.

Referring to FIG. 2, the bottom wall of the container 10 includes a planar underface 40 which is included within a downwardly extending peripheral border which is defined by a series of legs 42, 44, 46, 48, 50 and 52. The spaces between the legs define pockets 54, 56, 58, 60, 62 and 64. Legs 42, 44, 46 and 48 define C-shaped corner sections while legs 50 and 52 are straight.

Figure 5:
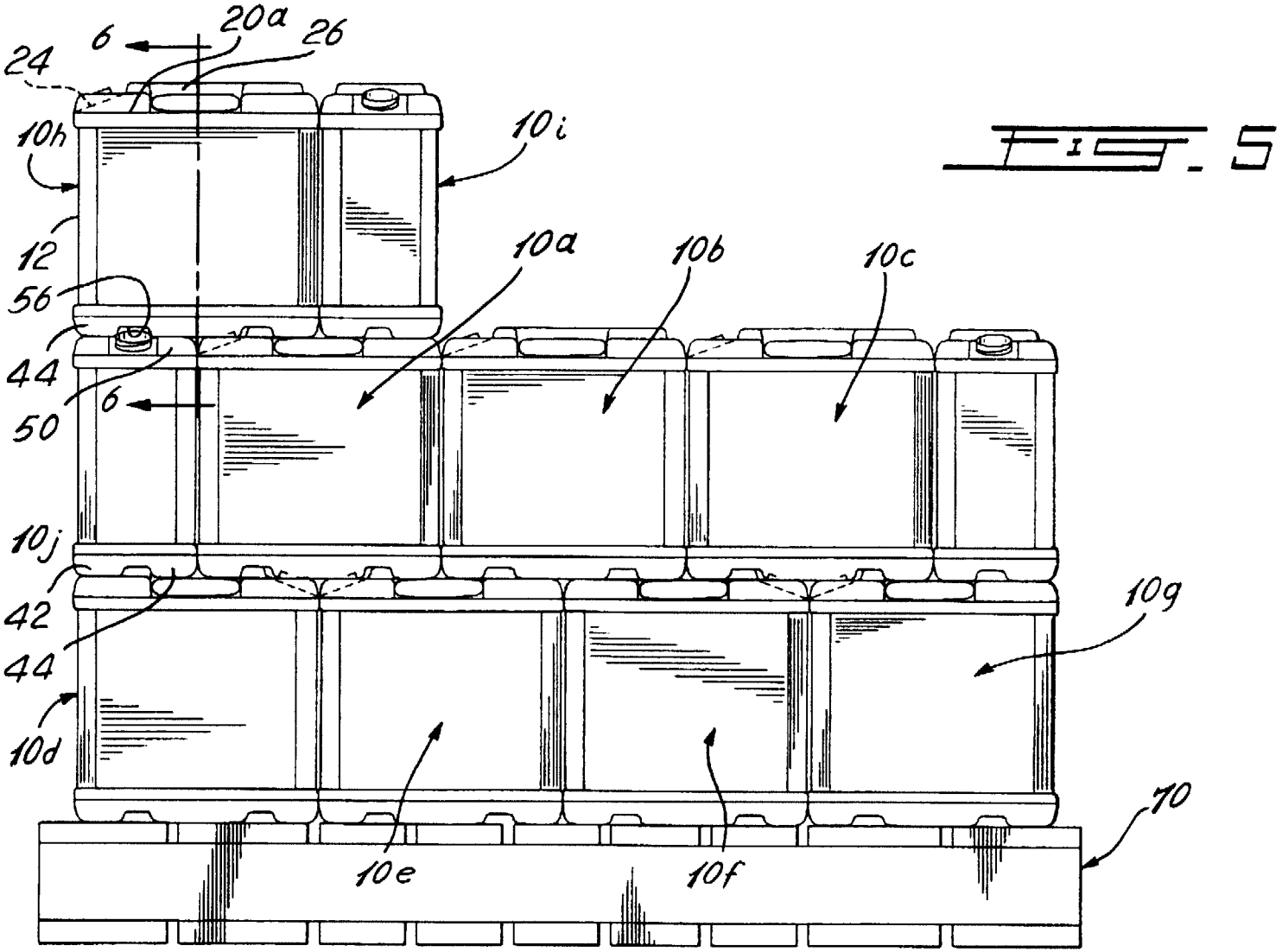
FIG. 5 is an elevational view of containers in various stacked relationships.

The configurations of the top wall and of the bottom wall are such that similarly-constructed containers 10 may be stacked in a first relationship which is in a common vertical plane, either one container directly above the other, or in a half-length offset condition (see containers **10*a* to log in FIG. 5). Containers may also be stacked in a second relationship which is in planes 90° with respect to one another (as illustrated in FIG. 1**). This of course is achieved due to the 2 to 1 width ratio of that between the front and rear walls to that between the opposite side walls.

Figure 3:
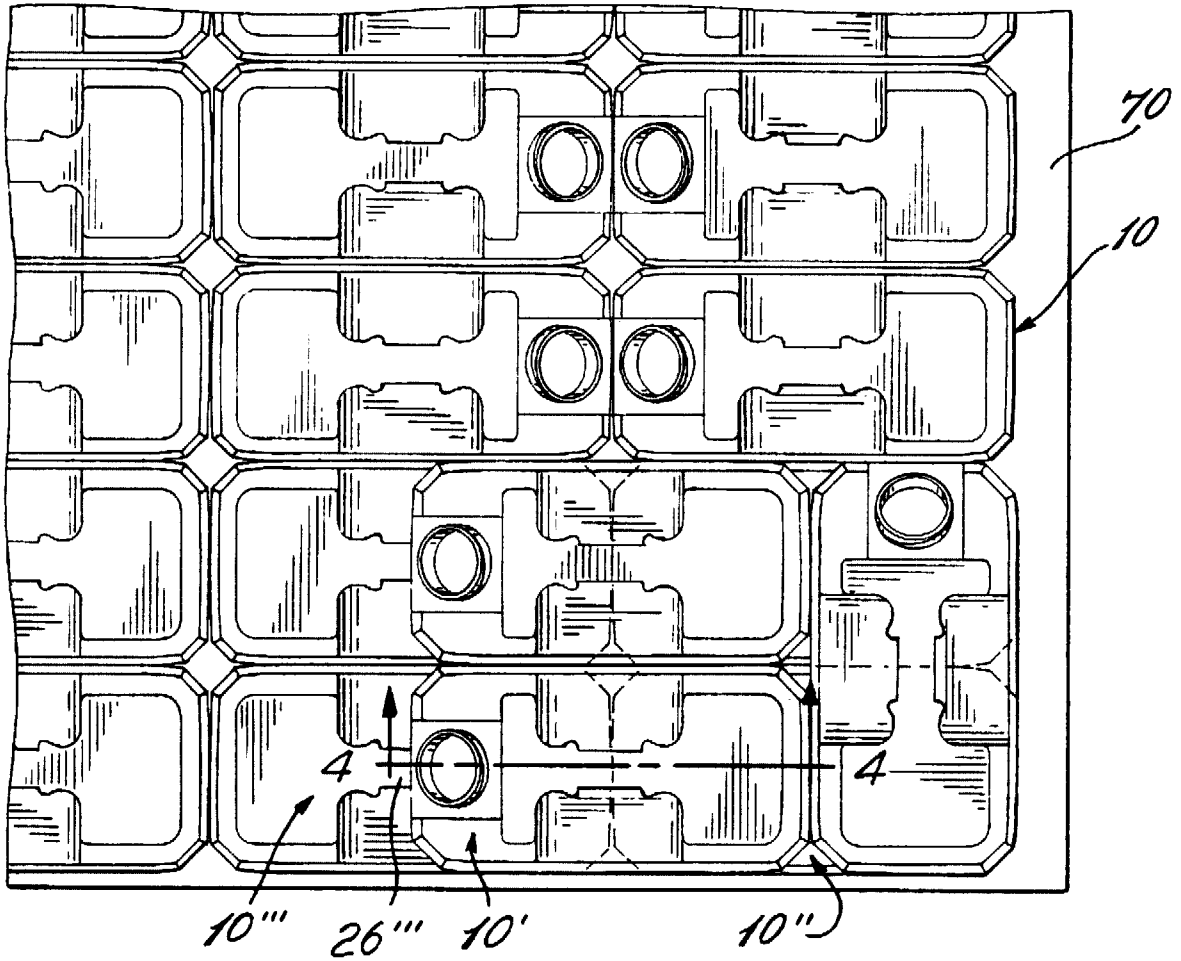
FIG. 3 is a top plan view showing three containers in a stacked relation to an arrangement of horizontally disposed containers.
Figure 4:
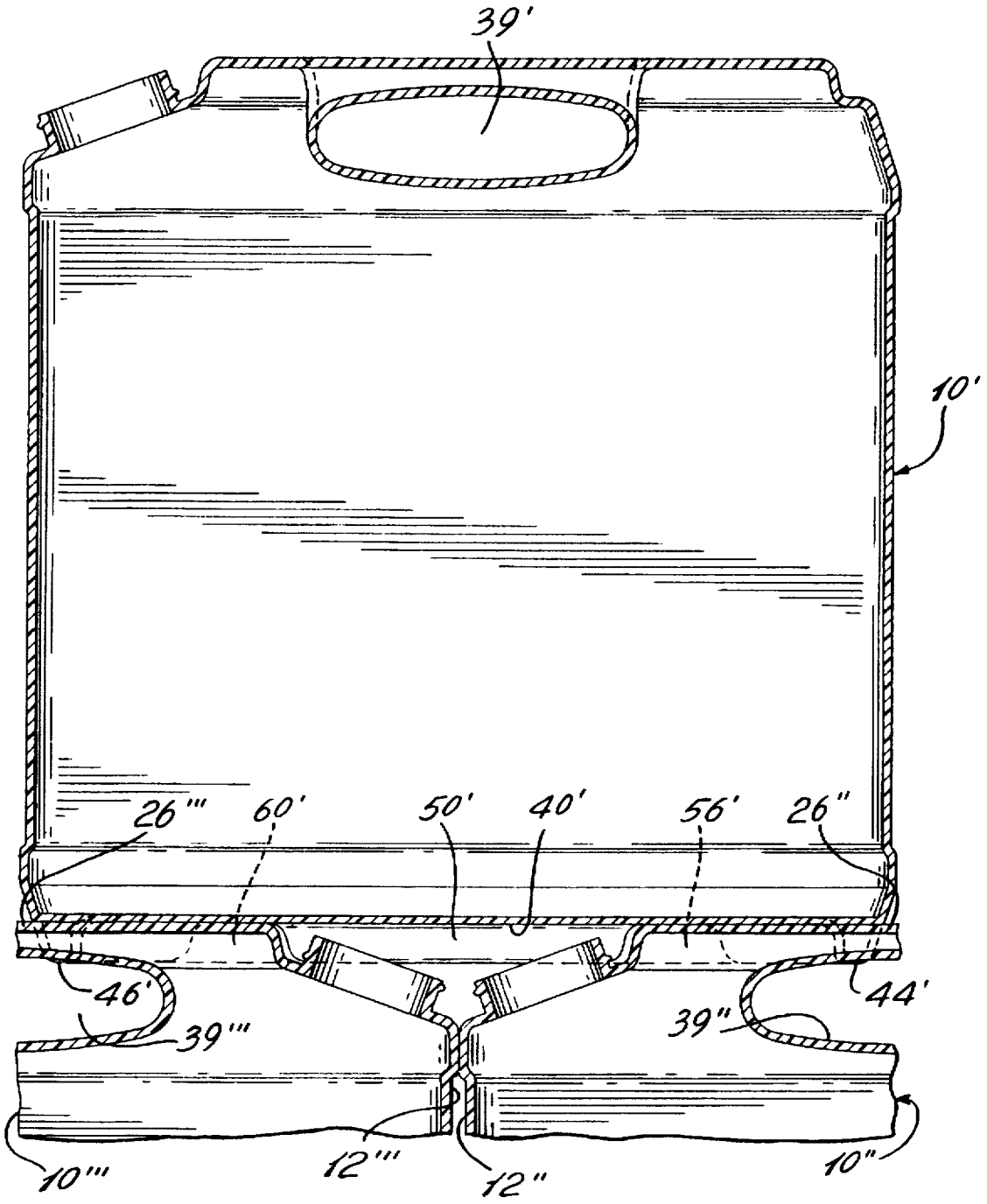
FIG. 4 is a cross-sectional view taken along lines 4—4 of FIG. 3.

Referring to FIGS. 3 and 4, there is shown one horizontal row of containers 10 resting on a pallet 70. An upper container 10' is shown resting on two lower containers 10" and 10''', the latter two containers facing one another with their front walls 12" and 12''' contacting one another. It can be seen that half the area of the underface 40' of container 10' rests over the handle bar 26''' of container 10''' while the other half rests over the handle bar 26" of the container 10". The rear corner legs 46' and 48' of container 10' extend over the finger-receiving recessed area 39" of container 10" while the front corner legs 42' and 44' extend over the recessed area 39''' of container 10'''. The pockets 62' and 64' of the container 10' receive the handle bar 26''' of container 10''' and handle bar 26" of container 10", respectively.

It is evident that two containers 10 could be stacked one above the other in which case legs 42 and 44, would rest on the rear top surface **20*b* while legs 46 and 48 would rest on the front top surface 20*a*. Still, such containers could be disposed 180° to one another in which case legs 42 and 44 would rest on the front top surface 20*a* while legs 46 and 48 would rest on the rear top surface 20*b*. In both cases, however, the handle bar area, including the handle bar 26 and the rectangular planar faces 28 and 30, would bear against the underface 40** of the superposed container.

As can be seen in FIGS. 1 and 5, the containers may be stacked in planes 90° to one another.

Figure 6:
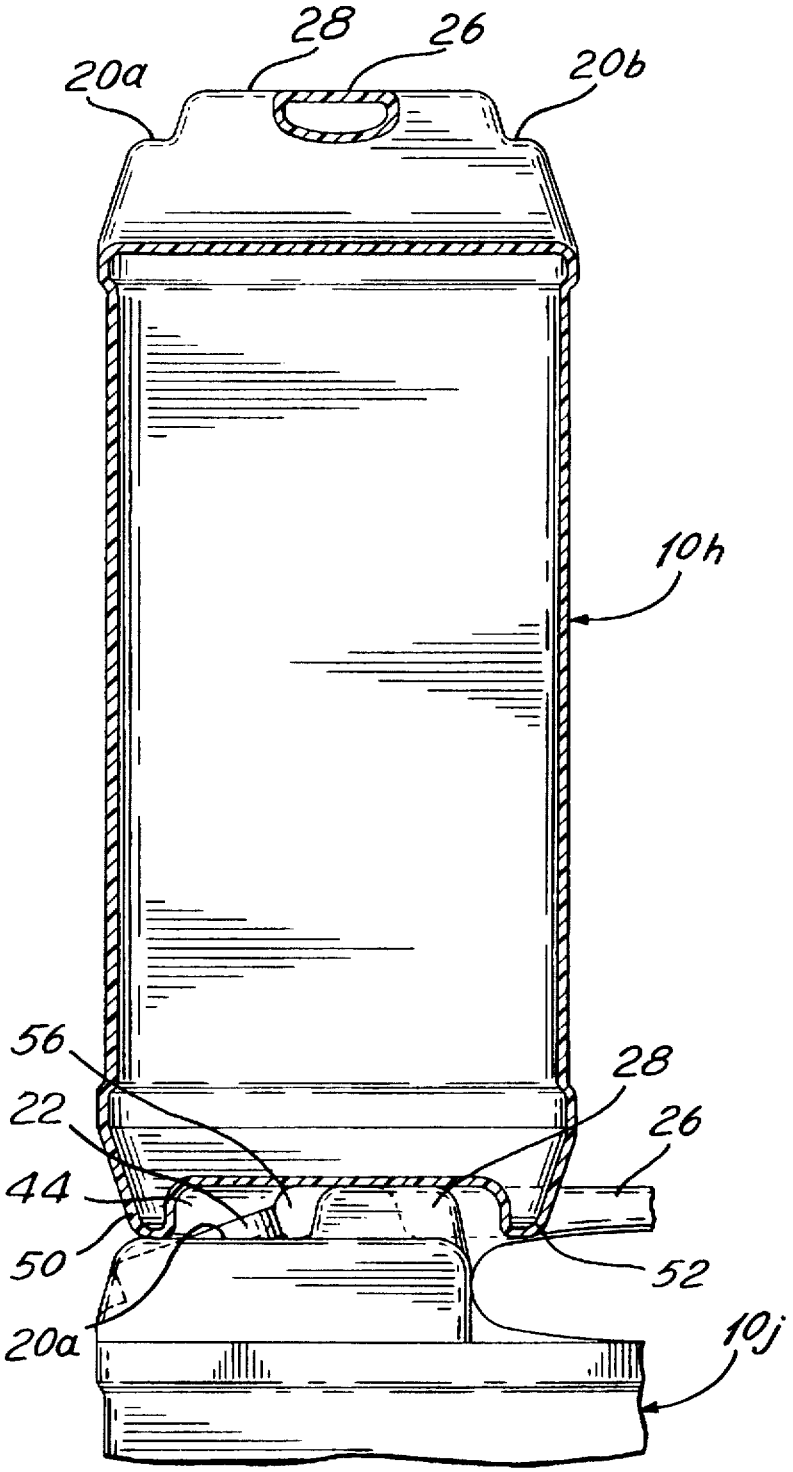
FIG. 6 is a cross-sectional view taken along lines 6—6 of FIG. 5.

Referring to FIGS. 5 and 6, containers **10*a*, 10*i*, 10*h* and 10*j* are disposed in such planes. Container 10*j* is at 90° with respect to container 10*h* while container 10*i* is at 90° with respect to container 10*a*. It is to be noted that container 10*h* is in a common vertical plane with container 10*a* but offset to it by half the width of the container's side walls. Although not shown, a container, disposed similarly as container 10*h*, could be vertically stacked in the same vertical plane over container 10*b* or 10*c*** for example.

The distance separating projections 32 and 36 as well as that separating projections 34 and 38 is greater than the width of the various pockets 54, 56, 58, 60, 62 and 64 so that, when the latter engage a handle bar, these projections act as stoppers against longitudinal sliding and provide additional securement of containers in stacked condition.

Although the invention has been described above with respect with one specific form, it will be evident to a person skilled in the art that it may be modified and refined in various ways. For example, some containers may be formed of two spout areas, one at each opposite end of the top wall; in such case, both opposite rectangular planar faces would have the same surface area. Also, some containers could be provided with reinforcing means on their walls to bear the stacking weight. It is therefore wished to have it understood that the present invention should not be limited in scope, except by the terms of the following claims.

The embodiments of the invention in which an exclusive property or privilege is claimed are defined as follows:

1. A container for liquids configured for two-plane stacking with similarly constructed containers comprising a body having a rectanguloid configuration including a front wall, a rear wall, a pair of opposite side walls, a bottom wall and a top wall; said top wall including a top surface having a recessed liquid pouring spout area and a raised handle area; said handle area including a handle bar and a rectangular planar face contiguous with each opposite end of the handle bar; said bottom wall having an underface included within a downwardly extending peripheral border defined by a series of spaced legs and displaying pockets between said legs; said legs being adapted to rest on the top surface of one or two containers when disposed therebeneath in stacked relation; said handle bar being adapted to extend through pockets of two containers when stacked either in planes 90° to one another or when stacked in a common plane but vertically offset to one another; said raised handle area being received within said border under the underface of a superposed container vertically stacked thereunder; said rectangular planar faces and said handle bar of one container cooperating with the legs and pockets of another container to secure said containers in stacked condition.

2. A container as defined in claim 1, wherein said handle bar includes small projections on opposite sides thereof to further secure said stacked condition.

3. A container as defined in claim 1, wherein said legs consist of four C-shaped corner sections and a pair of opposite side sections; a pair of pockets being provided along each side of said border and one pocket being provided at each end of said border.

4. A container as defined in claim 1, wherein said top wall includes a finger receiving recess under said handle bar.

5. A container as defined in claim 1, wherein said spout area includes a pouring opening disposed on an inclined face contiguous with said front wall.

6. A container as defined in claim 5, wherein said rectangular planar faces of said handle area include a first flat face adjacent said inclined face and a second flat face adjacent said rear wall; said first face having a surface area smaller than that of said second face.

* * * * *